United States Patent [19]

Madsen et al.

[11] 4,432,806

[45] Feb. 21, 1984

[54] METHOD OF PURIFYING SUGAR JUICE PREPARED BY EXTRACTION OF A SUGAR BEET MATERIAL

[75] Inventors: Rud F. Madsen, Strandpromenaden; Werner K. Nielsen; Steen Kristensen, both of Bresemannsalle, all of Denmark

[73] Assignee: Aktieselskabet de Danske Sukkerfabrikker, Copenhagen, Denmark

[21] Appl. No.: 338,071

[22] Filed: Jan. 8, 1982

[30] Foreign Application Priority Data

Jan. 14, 1981 [SE] Sweden ..... 8100186

[51] Int. Cl.[3] ..... C13D 3/16

[52] U.S. Cl. ..... 127/48; 127/55; 210/638; 210/639

[58] Field of Search ..... 210/638, 639, 650, 651, 210/806; 127/51, 50, 48, 52, 55, 44, 54

[56] References Cited

U.S. PATENT DOCUMENTS

| | | | |
|---|---|---|---|
| 2,082,656 | 6/1937 | Reichert et al. | 127/48 |
| 3,758,405 | 9/1973 | Fremont | 210/639 X |
| 3,799,806 | 3/1974 | Madsen | 210/638 X |
| 4,014,787 | 3/1977 | Shorr | 210/639 |
| 4,076,552 | 2/1978 | Farag et al. | 127/52 X |
| 4,234,350 | 11/1980 | Suzor | 127/48 |
| 4,288,551 | 9/1981 | Gudnason et al. | 127/48 X |

FOREIGN PATENT DOCUMENTS 1361674 7/1974 United Kingdom .

OTHER PUBLICATIONS

Michaels, A. S.; Chem. Eng. Progress, vol. 64, No. 12, Dec., 1968; p. 31; "New Separation Technique for the CPI".

*Primary Examiner*—Kenneth M. Schor

*Attorney, Agent, or Firm*—Watson, Cole, Grindle & Watson

[57] ABSTRACT

Method of purifying sugar juice which has been prepared by extraction of a sugar beet material comprising mechanically separating undissolved components, chemically treating the juice to convert low molecular non-sugars into higher molecular compounds and to convert non-soluble compounds into soluble compounds and ultrafiltering the sugar juice thus obtained to separate high molecular components therefrom, thus obtaining a purified sugar juice which is suitable for the manufacture of crystalline sugar of a higher quality than conventionally purified sugar juice.

14 Claims, No Drawings

METHOD OF PURIFYING SUGAR JUICE PREPARED BY EXTRACTION OF A SUGAR BEET MATERIAL

BACKGROUND OF THE INVENTION

This invention relates to a method of purifying sugar juice which has been prepared by extraction of a sugar beet material wherein undissolved components are mechanically separated from the sugar juice and high molecular components are subsequently separated from the juice thus obtained.

In the production of sugar from sugar beets the beets are sliced and the slices thus obtained are extracted with warm water, e.g., having a temperature of 70° C., so as to form a sugar juice and exhaust slices (pulp). The sugar juice, which is then separated from the pulp, contains in addition to sucrose various non-sugars, e.g. organic and inorganic salts, amino acids, dyes and high molecular substances, such as protein and pectin.

The sugar juice thus obtained is then purified to remove the non-sugars.

In a conventional juice purification method lime (CaO) and carbon dioxide ($CO_2$) are added, the carbon dioxide being prepared by heating limestone in a lime kiln based on the use of solid fuel, e.g., cinders.

The addition of lime and carbon dioxide results in the formation of a precipitate (sludge) consisting of calcium carbonate and part of the above-mentioned non-sugars. The sludge is removed by filtration, e.g., on a rotating vacuum, filter. The dewatered sludge thus obtained is optionally used as a soil-improving material.

The filtrate obtained by removing the sludge by filtration still contains some lime (CaO) and, therefore, additional amounts of carbon dioxide and, optionally, soda may be added, and the pH may also be adjusted to a value of between 9.0 and 9.2 to form additional sludge, which is subsequently removed by filtration.

The filtrate thus obtained may be treated with sulfur dioxide ($SO_2$) before it is worked up in a conventional manner, e.g., to form crystalline sugar.

The specification of British Pat. No. 1,361,674 discloses a method in which the conventional juice purification method has been replaced by a purification procedure in which the initial mechanical removal of undissolved material, e.g., by normal filtration, is followed by a step in which the juice is subjected to ultrafiltration. The ultrafiltration is effected with a membrane of the type which permits the passage of water and sucrose molecules but rejects higher molecular compounds. After an initial ultrafiltration, water may be added to the concentrate, which is then subjected to a further ultrafiltration. This procedure is optionally repeated.

Finally, the permeates thus obtained are subjected to one or more after-treatments in the form of a chemical treatment, a conventional filtration, an ion exchange treatment or a hyperfiltration. In connection with these treatments the pH value of the sugar juice may be adjusted to 6–11.5, e.g., by the addition of lime (CaO).

The above-mentioned prior art method does not constitute an economically satisfactory manner of providing a sugar juice which is sufficiently colourless to allow high quality sugar, i.e. white sugar, to be prepared therefrom. It is assumed that this is due to some low molecular dyes which together with the sucrose molecules pass through the membrane and into the permeate during the ultrafiltration step.

The object of the present invention is to provide a method for the purification of sugar juice which does not suffer from the above-mentioned drawback and which is simpler and less expensive than the conventional lime purification method.

SUMMARY OF THE INVENTION

This object, and other objects which will become clear in the following description, are obtained by the method of the invention in which the mechanical separation of undissolved components from the juice is followed by a chemical treatment to convert low molecular non-sugars into higher molecular compounds, and in which the juice thus obtained is ultrafiltered and optionally subjected to a lime treatment to precipitate acid residues.

The chemical treatment to convert low molecular non-sugars into higher molecular compounds i.a. has the effect that dyes are converted into compounds which can be removed during the subsequent ultrafiltration. The low molecular compounds are mainly phenolic compounds, e.g., 3,4-dihydroxy-phenylalanine. The addition of an oxidant, such as hydrogen peroxide, aeration of the juice or the addition of a complexing agent, such as ferri chloride and aluminum sulphate, of which ferri chloride is also capable of acting as an oxidant, has the effect of increasing the molecular weight of the compounds, e.g., as a result of a polymerization.

The chemical treatment is preferably effected at a temperature of 60°–70° C. It may be desirable to adjust the pH value of the juice to 6.8–7.2 by means of a base, e.g., soda or sodium hydroxide, because such adjustment of the pH value promotes the polymerization.

By converting high molecular compounds, such as pectin and proteins, into a soluble form, the filtration capacity of the ultrafiltration apparatus used in the subsequent ultrafiltration step is also increased.

The effect of the chemical treatment as far as the colour of the sugar juice is concerned will appear from the following table, Table I, which sets forth colour data obtained with and without a chemical treatment.

TABLE I

| Test No. | Chemical treatment | ICUMSA colour* |
|---|---|---|
| 1 | None | 2000–2700 |
| 2 | 0.02% $H_2O_2$, 80°0 C. 15 min. | 1300 |
| 3 | Aeration | 1450 |
| 4 | Aeration + 0.007% $H_2O_2$ | 1300 |
| 5 | 100 ppm $FeCl_3$, 60° C. 30 min. | 1160 |
| 6 | 100 ppm $FeCl_3$ + aeration, 60° C. 30 min. | 1050 |

*determined by the method described by F. Schneider: Sugar Analysis, ICUMSA Methods, Peterborough, England 1979.

As will appear from Table I, the chemical treatment significantly improves the colour of the sugar juice.

The following table, Table II, sets forth the properties of the sugar juice following various chemical treatments and an ultrafiltration.

TABLE II

| Chemical treatment | Average Flux, $l/m^2/h$ at 80° C. | Q* | ICUMSA Colour** | Invert Sugar*** | CaO, % |
|---|---|---|---|---|---|
| 0.2% $H_2O_2$, 80° C. | ~45 | 91.9 | 1544 | 0.5–1 | 0.025 |
| Aeration | ~47 | 92.2 | 3100 | 0.5–1 | 0.025 |
| 100 ppm $FeCl_3$, 20° C. | 47 | 91.7 | 2726 | 0.5–1 | 0.025 |
| 100 ppm $FeCl_3$ + 0.024 $H_2O_2$, pH = 6.5–6.7, 20° C. | 51.9 | 90.7 | 1989 | 0.5–1 | 0.025 |
| 100 ppm $FeCl_3$ + 0.024% $H_2O_2$, pH = 7.0, 20° C. | 67.9 | 92.7 | 2567 | 0.5–1 | 0.025 |

*Q = purity, i.e. the ratio, expressed in % of the amount of sugar to dry solids determined on the basis of refractive index.
**determined by the method described by F. Schneider: Sugar Analysis, ICUMSA Methods, Peterborough, England 1979.
***the concentration of invert sugar in % based on the dry solids content determined on the basis of the refractive index.

As will appear from Table II, the flux is significantly increased when the pH value of the juice is increased from 6.5–6.7 to 7.0.

The ultrafiltration is preferably effected at a temperature of 80°–90° C. and under a pressure of 1–10 $kp/cm^2$. The membranes used in such a process, e.g., membranes made from polymers, have properties such that they allow the passage of low molecular compounds, such as sucrose, glucose, fructose, inorganic and organic acids and amino acids, whereas high molecular substances, such as pectin, proteins, dextranes and high molecular dyes are rejected.

In a typical ultrafiltration of chemically treated juice, 90–95% by weight of the sugar juice is removed as permeate. Wash water is preferably added in such an amount that the total amount of permeate is equal to the amount of sugar juice being treated. Thus, it is preferred to add water either continuously or batchwise to the concentrate when the major proportion of juice, e.g., 90% by volume, has been removed during the ultrafiltration as a permeate and to further concentrate the diluted concentrate by ultrafiltration. The concentrate which as mentioned above constitutes about 5% of the total amount of sugar juice being treated, typically contains from about 3.5 to about 4.0% of the total amount of sugar of the beet material, and the content of sugar in the concentrate is about 50–60% based on the total amount of dry solids (thus, the concentrate has a purity of 50–60).

As will appear from the above Table II, the sugar juice (permeate) formed during the ultrafiltration has essentially the same properties as far as colour and purity are concerned as sugar juice obtained by a conventional purification. The purified juice contains some organic and inorganic acids which, according to a preferred embodiment of the method of the invention are precipitated by the addition of lime in smaller amounts, e.g., corresponding to an amount of $CaCO_3$ which is equal to 0.03–0.06% of the weight of the beet material. When adding lime a precipitate consisting of i.a. phosphoric acid, lactic acid and citric acid salts is formed.

When the juice is heated to a temperature of about 100° C., the precipitated salts are converted into a sediment and the pH value of the juice is stabilized because amino acids, such as glutamine and asparagine, are saponified. The settled salts are removed, preferably by decantation, in a thickener or by filtration. The sugar juice thus obtained may then be treated with $SO_2$ before it is objected to further conventional treatments.

The following Table III contains typical data obtained by the purification of sugar juice in the method according to the invention and in a conventional lime purification method.

TABLE III

| | Method according to the invention | Conventional lime purification method |
|---|---|---|
| Thin juice, amount relative to the weight of the beet material | ~120% | ~120% |
| Thin juice data | 13–15 | 13–15 |
| Dry solids content (Bx value) determined on the basis of refractive index | | |
| Sugar content | 12–14% | 12–14% |
| Q* | 92–93 | 92–93 |
| ICUMSA colour** | 2000–3000 | 1300–2500 |
| Invert sugar relative to the dry solids content | 0.5–1% | 0.01–0.05% |
| CaO, % | ~0.017 | 0.004 |
| pH | about 9 | about 9 |
| Further data: | | |
| Consumption of CaO relative to the weight of the best material | 0.05 | 2–3% |
| Consumption of $FeCl_3$ | 100 ppm | — |
| Consumption of $SO_2$ | 150 g S/t of beets | 150 g S/t of beets |
| Consumption of $Na_2CO_3$ | — | 500 g/t of beets |

*Q = purity, i.e., the ratio expressed in % of the amount of sugar to dry solids determined on the basis of refractive index.
**determined by the method described by F. Schneider: Sugar Analysis, ICUMSA Mehods, Peterborough, England 1979.

As will appear from the above Table III, the consumption of CaO and consequently the consumption of limestone and cinders is considerably smaller in the method according to the invention than in the conventional purification method. Thus, the expenses relating to lime kiln, slacking equipment, liming tanks and filters may be considerably reduced.

The above-mentioned reduction of the operational costs corresponds to the costs for chemicals for use in the chemical treatment, e.g., $H_2O_2$ and/or $FeCl_3$, and to the energy necessary for the operation of the ultrafiltration apparatus which is involved in the method of the invention. However, the reduction of the costs of construction are considerably higher than the additional expenses for ultrafiltration apparatus, precipitation tank and filter or thickener which are used in the method of the invention because the costs of construction of a juice purification system according to the invention amount to only 50–60% of the costs of construction of a conventional juice purification apparatus.

Furthermore, the method of the invention presents the advantage, compared to the conventional purification method, that the concentrate obtained by the ultrafiltration can be utilized in a much more economical manner, i.e., as a molasses-like material for use as an animal feed, than the sludge obtained by the conventional purification method which sludge is suitable only as a soil-improving product.

The invention will now be described in further detail with reference to the following examples.

EXAMPLE 1

213 l of diffusion juice was filtered on a filter having mesh openings of about 20μ. In this manner pulp residues, gravel, etc., were removed. 100 ppm $FeCl_3$ and 0.024% $H_2O_2$ at a temperature of 20° C. were added to the juice. The diffusion juice thus treated was then heated to 80° C. and was ultrafiltered in a DDS ultrafiltration apparatus. The ultrafiltration was carried out at an average pressure of 4.5 bars and a temperature of 80° C. with DDS GR61P membranes. The pH value of the diffusion juice was adjusted to about 7 with NaOH and this pH value was maintained during the ultrafiltration. After removal of 170 l permeate, the concentrate was diafiltered with 40 l of water and subsequently a further amount of permeate was removed so that the total amount of permeate constituted 230 l. The concentrate amounted to 13 l. The average capacity during the ultrafiltration was 69.9 l/m$^2$.h. Analysis of the permeate and the concentrate gave the following results:

| | Bx-value, % | Sugar content, % | Q | ICUMSA colour | % CaO | Invert sugar | pH | Amount kg |
|---|---|---|---|---|---|---|---|---|
| Permeate | 12.6 | 11.68 | 92.7 | 2567 | 0.024 | ~1% | 7.1 | 230 |
| Concentrate | 11.2 | 5.72 | 51.1 | | | | 7.2 | 13 |

Subsequently, about 0.05% CaO was added to the permeate to adjust the pH value to 8.8. The sugar juice was then heated to 100° C. The temperature was maintained at 100° C. for 15 minutes, whereafter the precipitate formed was removed by filtration. Analysis of the sludge formed showed that various Ca and Mg salts of phosphate as well as organic acids, such as citric acid, lactic acid and acetic acid, were precipitated during the liming.

After the liming was completed, 600 mg $Na_2SO_3$ were added per kg of juice to form a thin juice having the following data:

| | Bx-value, % | Sugar content, % | Q | ICUMSA colour | % CaO | Invert sugar | pH |
|---|---|---|---|---|---|---|---|
| Thin juice | 13.6 | 12.40 | 91.2 | 2795 | 0.017 | ~1% | 9.00 |

After evaporation, in a laboratory evaporator a thick juice having the following data was obtained:

| | Bx-value, % | Sugar content, % | Q | ICUMSA colour | % CaO | Invert sugar | pH |
|---|---|---|---|---|---|---|---|
| Thick juice | 70.4 | 65.45 | 92.96 | 3338 | 0.071 | 1.47% | 8.7 |

EXAMPLE 2

250 l diffusion juice was filtered on a filter having mesh openings of about 20μ. 100 ppm $FeCl_3$ and 0.024% $H_2O_2$ at 20° C. were added to the filtered juice. The juice thus treated was then heated to 80° C. and ultrafiltered in a DDS ultrafiltration apparatus with DDS GR61P membranes, at an average pressure of 4.5 bars and at a temperature of 80° C. The pH value of the diffusion juice was adjusted to 6.5–6.7 with NaOH and this pH value was maintained during the ultrafiltration after removal of 210 l of permeate the concentrate was diafiltered with 40 l of water, and subsequently a further amount of permeate was removed so as to obtain a total amount of permeate of 270 l. The amount of the concentrate was 20 l. The average capacity during the ultrafiltration was 51.9 l/m$^2$.h. Analyses of the permeate and the concentrate gave the following data:

| | Bx-value, % | Sugar content, % | Q | ICUMSA colour | % CaO | Invert sugar | pH | Amount, kg |
|---|---|---|---|---|---|---|---|---|
| Permeate | 14.5 | 13.15 | 90.7 | 1989 | 0.029 | ~1% | 6.6 | 270 |
| Concentrate | ~12.0 | 6.95 | 57.9 | | | | 6.7 | 20 |

Subsequently, 0.05% CaO was added to the permeate to obtain a pH value of 8.8, and the juice was then heated to 100° C. The temperature was maintained at 100° C. for 15 minutes, whereafter the precipitate formed was removed by filtration. 600 mg $Na_2SO_3$ per kg of juice were added to the filtrate to form a thin juice having the following data:

| | Bx-value, % | Sugar content, % | Q | ICUMSA colour | % CaO | Invert sugar | pH |
|---|---|---|---|---|---|---|---|
| Thin juice | 14.8 | 13.55 | 91.6 | 2500 | 0.020 | ~1% | 8.6 |

After evaporation, in a laboratory evaporator a thick juice having the following data was obtained:

| | Bx-value, % | Sugar content, % | Q | ICUMSA colour | % CaO | Invert sugar | pH |
|---|---|---|---|---|---|---|---|
| Thick juice | 70.3 | 64.62 | 91.9 | 3336 | 0.078 | 1.6% | 8.9 |

EXAMPLE 3

220 kg of diffusion juice having a Bx-value of 15.4%, which corresponds to 33.8 kg dry solids, a sugar concentration of 13.65%, which corresponds to an amount of sugar of 30.0 kg and a purity (Q) of 88.64, which corresponds to a content of non-sugars of 3.8 kg, was treated as described in example 1. During the ultrafiltration 11 kg of water were added. The ultrafiltration resulted in 220 kg ultrafiltered diffusion juice having a Bx-value of 14.4%, which corresponds to 31.7 kg dry solids, a sugar concentration of 13.21%, which corresponds to 29.0 kg sugar, and a purity (Q) of 91.50, which corresponds to 2.7 kg non-sugars, and 11.0 kg of washed concentrate having a Bx-value of 19.1%, which corresponds to 2.10 kg dry solids, a sugar concentration of 9.05%, which corresponds to 1.00 kg of sugar, and a purity (Q) of 47.4, which corresponds to 1.10 kg non-sugars.

We claim:

1. A method of purifying sugar juice which has been extracted from a sugar beet material, said method comprising the steps of (a) filtering the sugar juice to remove undissolved components therefrom, (b) adding to the filtered sugar juice obtained in step (a) a chemical selected from the group consisting of oxidants, complexing agents and mixtures thereof in an amount sufficient to convert low molecular weight colored components in the filtered sugar juice into compounds of a molecular weight sufficiently high that they can be separated from the filtered sugar juice by ultrafiltration, and (c) ultrafiltering the chemically treated sugar juice obtained in step (b) to provide a retentate containing the high molecular weight compounds and a permeate in the form of a purified sugar juice concentrate.

2. A method as in claim 1, wherein after the addition of the chemical to the filtered sugar juice in step (b) said filtered sugar juice is heated to a temperature of about 60° C. to 80° C.

3. A method as in claim 1, wherein during step (b) the pH of the filtered sugar juice is maintained at 6.8–7.2.

4. A method as in claim 1, wherein said ultrafiltrating in step (c) is effected at a temperature of 80°–90° C.

5. A method as in claim 1, comprising the additional steps of adding water to said purified sugar juice concentrate when the major proportion of said chemically treated sugar juice has been ultrafiltered in step (c) to thus form a diluted purified sugar juice concentrate, and subjecting said diluted purified sugar juice concentrate to a further ultrafiltration step to obtain a purified sugar juice reconcentrate.

6. A method as in claim 1, including the additional step of mixing lime with said purified sugar juice concentrate to form a precipitate containing acid residues.

7. A method as in claim 6, including the additional step of filtering said lime-treaated purified sugar juice concentrate to remove said precipitate.

8. A method as in claim 6, including the additional step of heating the lime-treated purified sugar juice concentrate to about 100° C.

9. A method as in claim 7, including the additional step of adding $SO_2$ to the lime-treated purified sugar juice concentrate.

10. A method as in claim 1, wherein said chemical added to said filtered sugar juice in step (b) includes an oxidant.

11. A method as in claim 10, wherein said oxidant is hydrogen peroxide.

12. A method as in claim 1, wherein said chemical added to said filtered sugar juice in step (b) includes a complexing agent.

13. A method as in claim 12, wherein said complexing agent is ferric chloride.

14. A method as in claim 12, wherein said complexing agent is aluminum sulphate.

* * * * *